US008623467B2

(12) United States Patent
Mariotti et al.

(10) Patent No.: US 8,623,467 B2
(45) Date of Patent: Jan. 7, 2014

(54) TACTILE PRINTING

(75) Inventors: Andrea Mariotti, San Carlos, CA (US); Kenneth F. Gudan, Sunnyvale, CA (US)

(73) Assignee: Ricoh Co., Ltd., Tokyo (JP)

( * ) Notice: Subject to any disclaimer, the term of this patent is extended or adjusted under 35 U.S.C. 154(b) by 729 days.

(21) Appl. No.: 11/958,119

(22) Filed: Dec. 17, 2007

(65) Prior Publication Data

US 2009/0155483 A1 Jun. 18, 2009

(51) Int. Cl.
*B41J 3/32* (2006.01)
*B41J 11/02* (2006.01)

(52) U.S. Cl.
USPC ..... 427/511

(58) Field of Classification Search
USPC ..... 427/511, 256, 287, 288; 118/46; 156/272.2, 275.5, 275.7
See application file for complete search history.

(56) References Cited

U.S. PATENT DOCUMENTS

| | | | | | |
|---|---|---|---|---|---|
| 5,397,673 | A | * | 3/1995 | Watson et al. | 430/124.22 |
| 5,512,122 | A | * | 4/1996 | Sokyrka | 156/275.5 |
| 5,627,578 | A | * | 5/1997 | Weintraub | 347/101 |
| 5,649,480 | A | | 7/1997 | Yim | |
| 5,733,127 | A | * | 3/1998 | Mecum | 434/113 |
| 5,968,607 | A | | 10/1999 | Lovison | |
| 6,164,850 | A | * | 12/2000 | Speakman | 400/120.09 |
| 6,402,403 | B1 | | 6/2002 | Speakman | |
| 6,755,350 | B2 | | 6/2004 | Rochford et al. | |
| 2007/0052980 | A1 | * | 3/2007 | Lee | 358/1.1 |

FOREIGN PATENT DOCUMENTS

| | | | |
|---|---|---|---|
| EP | 1563914 | A1 | 8/2005 |
| JP | 2000 052602 | A | 2/2000 |
| JP | 2004279491 | | 10/2004 |
| JP | 2007093869 | | 4/2007 |
| JP | 2008213151 | | 9/2008 |
| JP | 2008213152 | | 9/2008 |
| JP | 2008275970 | | 11/2008 |

OTHER PUBLICATIONS

European Extended Search Report, European Application No. 08253973.5, Mar. 27, 2009, 6 pages.

Dinar, S. et al., "Incorporating Unique Tactile Graphic Software with Inkjet to Improve Tactile Map Design and Availability," Digital Fabrication 2005, Final Program and Proceedings, Sep. 18-22, 2005, pp. 63-67, Society for Imaging Science and Technology, Springfield, VA, USA.

Duran, P., "Three Dimensional Inkjet Printer for Braille & Tactile Graphics," 20th Annual International Conference, Mar. 14-19, 2005, Center on Disabilities, Los Angeles, CA, USA, [online] [Retrieved on Dec. 7, 2007] Retrieved from the Internet<URL:http://www.csun.edu/cod/conf/2005/proceedings/2178.htm>.

"GelSprinter™ Technology—GelJet Viscous Ink," Ricoh, USA, [online] [Retrieved on Jun. 14, 2007] Retrieved from the Internet<URL:http://www.ricoh-usa.com/products/geljet/ink.asp>.

Japanese Office Action for JP Patent Application No. 2008-320124 dated May 14, 2013, 3 pages.

* cited by examiner

*Primary Examiner* — Daniel McNally
(74) *Attorney, Agent, or Firm* — Patent Law Works LLP

(57) ABSTRACT

A small home/office tactile printing system comprises a print head assembly and a paper feed assembly. The print head assembly includes a print head for printing with ink and an applicator for applying a liquid. The paper feed assembly moves paper (or any other medium suitable for printing) relative to the print head assembly and its components for printing the ink on the paper, applying the liquid to the medium and curing the liquid. The liquid is ultraviolet (UV) curable glue and curing is exposure of the UV liquid to UV light. The present invention also includes a variety of methods including a method for printing tactile information, a method for copying a document having tactile printing, a method for binding sheets of a media, a method for scratch-off printing and method for copying a bound document.

17 Claims, 7 Drawing Sheets

TACTILE PRINTING

BACKGROUND OF THE INVENTION

1. Field of the Invention

The present invention relates to printing devices and methods, and in particular, to a printing device capable of printing in three dimensions and a method of operation.

2. Description of the Background Art

There are a variety of different printing systems that employ different technologies such as laser printing, dot matrix and ink jet. These printing techniques have been included in various printers for the home or office. While the various prior art printing systems allow the user to control certain aspects such as print speed, print resolution, paper handling/flexibility and print color, most all printers are flat and the text is not raised on the paper.

The prior art does include printing techniques such as embossing or engraving for proving a tactile feel for the printing on the page. Typically, such embossing or engraving is a special process applied to the once the pages were printed. Since printing with embossing is a two stage process (ink first, emboss second), it is typically reserved for expensive off-site printing facilities. Some Braille embossed printers do exist which print Braille-only characters with embossing, or even Braille plus Ink characters as two separate processes within the same printer, but these devices are noisy (embossing) and inflexible (Braille-only).

Therefore, what is needed are systems and methods for printing that has a tactile feel or that is raised from the media (not only Braille) upon which it is printed in a convenient, fast, quiet device applicable for home and office use.

SUMMARY OF THE INVENTION

The present invention overcomes the deficiencies and limitations of the prior art by providing a system and method for performing tactile printing. In one embodiment, the system comprises a print head assembly and a paper feed assembly. The print head assembly includes a print head for printing with ink and an applicator for applying a liquid. The paper feed assembly moves paper (or any other medium suitable for printing) relative to the print head assembly and its components for printing the ink on the paper, applying the liquid to the medium and curing the liquid. In one embodiment, the liquid is ultraviolet (UV) curable glue and curing is exposure of the UV liquid to UV light. The present invention also includes a variety of methods including a method for printing tactile information, a method for copying a document having tactile printing, a method for binding sheets of a media, a method for scratch-off printing and method for copying a bound document.

BRIEF DESCRIPTION OF THE DRAWINGS

The invention is illustrated by way of example, and not by way of limitation in the figures of the accompanying drawings in which like reference numerals are used to refer to similar elements.

DETAILED DESCRIPTION OF THE PREFERRED EMBODIMENTS

A tactile printer and tactile printing method are described below. In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention. For example, the present invention is described primarily with reference to printing on paper using ink jet technology. However, the present invention applies to any type of printing on any type of media and using any technology. For example, ink gel may be used instead of conventional ink. The use of paper as the media is only by way of example as other media, such as plastic, metal, wood, electronic circuit boards or other substrates maybe used. Those skilled in the art will recognize that when such other media are used the media handling and printing mechanisms may be different than those disclosed below for conventional printing on paper. For example, the printing may be using a hand-held printer. The use of ink jet is only by way of example as the printing technology any existing printing technology such as laser, dot matrix, blue print or various other technologies.

Figure 1:
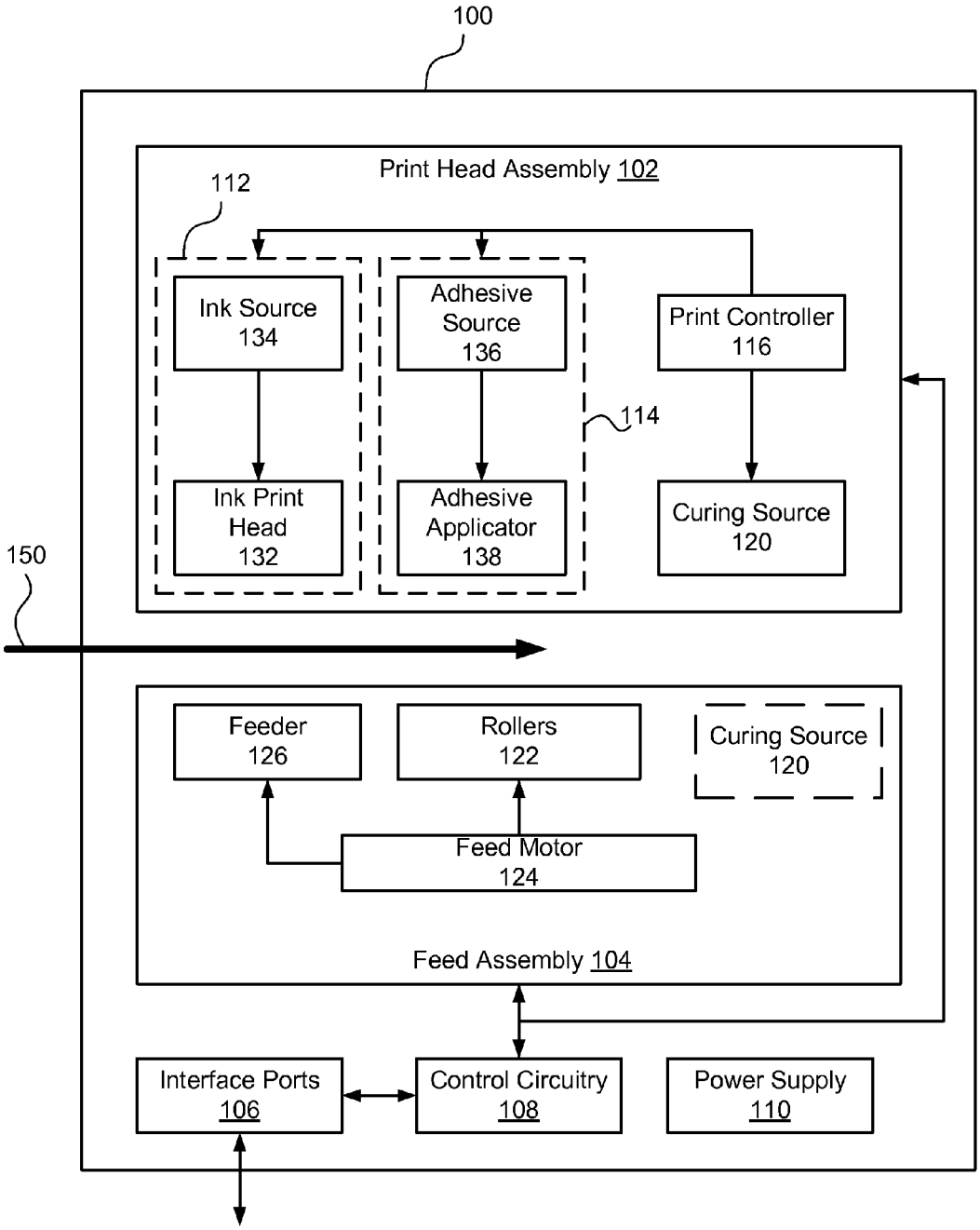
FIG. 1 is a high-level block diagram illustrating a functional view of a printer adapted for tactile printing according to one embodiment of the present invention.

FIG. 1 is a high-level block diagram illustrating a functional view of a printer 100 adapted for tactile printing according to one embodiment of the present invention. The printer 100 includes a print head assembly 102 for applying or depositing ink and other liquid to a media (not shown), and a feed assembly 104 for moving the media through the printer 100. The printer 100 also includes: interface ports 106 for connecting the printer 100 to a computer or a computer network (not shown); control circuitry 108 for controlling mechanical operation as well as processing information received by the printer 100 via the interface ports 106; and a power supply 110 for providing power to components of the printer 100. The printer 100 may also include other conventional components such as dedicated processor, a scanner, additional feeder and trays, an input device, etc. for printers with enhanced functionality beyond the basic printer such as all-in-one or multi-function printers with scan, fax, copy and print capabilities.

The feed assembly 104 moves media such as sheets of paper relative to the print head assembly 102 as shown generally by line 150. This causes the paper to pass past the components of the print head assembly 102 such that they can apply ink, apply adhesive and cure the adhesive. The print head assembly 102 and the feed assembly 104 are coupled to the control circuitry 108 for sending and receiving control signals that control the handling of the paper through the printer and the printing.

The print head assembly 102 includes an ink subsystem 112, an adhesive subsystem 114, a print controller 116 and a curing source 120. The ink subsystem 112 prints ink on the media, and the adhesive subsystem 114 applies adhesive to the media.

The print controller 116 controls the ink subsystem 112 and the adhesive subsystem 114. The print controller 116 is coupled for communication with the control circuitry 108, the ink subsystem 112 and the adhesive subsystem 114. In one embodiment, the print controller 116 includes a print head stepper motor for moving the print head assembly 102 across a page as the feed assembly 104 passes the paper or media past the print head assembly 102. The print controller 116 communicates with the control circuitry 108 to receive data and commands for printing. Responsive to signals from the control circuitry 108, the print controller 116 sends signals to the ink subsystem 112 and the adhesive subsystem 114 to movement of the ink print head 132 and the adhesive applicator 138, and the output of ink or adhesive by each of them, respectively.

The curing source 120 is also coupled for control by the print controller 116. The curing source 120 is preferably positioned in the paper path immediately after the adhesive applicator 138. The curing source 120 may be selectively activated in response to control signals from the print controller 116. For example, for normal printing without any tactile additions to the ink, the curing source 120 is not needed and remains deactivated. However, for those areas where the adhesive applicator 138 has applied material to the paper, the curing source 120 is activated to cure the adhesive. In one embodiment, an UV (ultraviolet) adhesive is used and the curing source 120 is a UV light source. Such adhesives are sold under the brand name Loctite. In another embodiment, the curing source 120 is a heat source. In one embodiment, the curing source 120 is included as shown as part of the print head assembly 102 to cure the UV adhesive in-situ, i.e., as it is deposited. In another embodiment, the curing source 120 is located at the paper eject path of the paper feed assembly 104, where it cures the UV adhesive on the whole page at once after the printing of the page is completed. In yet another embodiment where the adhesive cures very quickly such as by air drying no curing source is needed. Those skilled in the art will recognize that any number of different curing methods may be employed by the present invention. For example, in alternate embodiments, any chemical compound that can change its mechanical property by exposure to air, UV light, other sources of energy from any part of the electromagnetic spectrum. Similarly, the catalyst for curing may be direct exposure to the energy source such as but not limited to a laser controlled by optics, laser controlled by DLP chip, or similar technologies.

The ink subsystem 112 comprises an ink print head 132 and an ink source 134 such as an ink jet cartridge unit. The ink print head 132 includes a series of nozzles that are used to spray drops of ink onto paper. The ink is supplied by one or more cartridges referred to as the ink source 134. Different embodiments of the printer 100 may have different number of cartridges in the ink source 134, for example, only one black ink cartridge is used in a monochrome printer, and four cartridges each carrying cyan, magenta, yellow, and black ink (abbreviated as CMYK) may be used for color printing. The ink subsystem 112 may be any one of a conventional type of ink jet printing system known to those skilled in the art. The ink subsystem 112 is coupled to and under the control of the print controller 116 as will be described in more detail with reference to the methods shown and described below.

Similarly, the adhesive subsystem 114 comprises an adhesive applicator 138 and an adhesive source 136. The terms "adhesive" and liquid are used interchangeably throughout this application, referring to the liquid used in the present invention that is both highly viscous and curable. The adhesive applicator 138 is a nozzle and system capable of depositing large droplets of liquid. In one embodiment, the drop size is between 1.5 and 3 mm in diameter (10,000-200,000 pL volume). Because of the viscosity of the adhesive in this embodiment, it is not able to be sprayed to the media using standard ink jet technology. The adhesive is dispensed to the tip of an application needle (22-24 AWG diameter), and the needle tapped to the media to transfer the drop from the needle to the page. Thus, when applied, the liquid has a thickness above the plane of the paper approximately 0.15-0.75 mm. Taller features may be obtained by repetitive layers, but 0.5 mm features are quite sufficient for tactile feel, in only one pass. Essentially, the liquid must be capable of being deposited on the paper and retain its tactile shape. The liquid must also retain that state until it is cured, and not absorb into the paper. It may have a viscosity as high as 5000 cP (Centi-Poises), and may be cured upon exposure to heat, light, radiation or other environmental condition that will decrease the time required for the liquid to transition from the liquid state to the solid or semi-solid state. In one embodiment, the liquid is UV curable adhesive that is stored in the adhesive source 136. For this embodiment, the curing source 120 produces and applies to the paper and liquid, UV light at a wavelength of 415 nm. In one embodiment, an example cure time for 0.5-1 mm thick application of adhesive is about 1 second (based on UV light energy and distance from the substrate). Due to its high viscosity, the adhesive retains its large droplet shape upon deposition and forms tactile features upon curing on the paper. The adhesive may be clear/translucent or in partially opaque with color. While color adhesive may be used to produce color tactile features, clear adhesive allows overlaying of tactile and ink print. In one embodiment, the adhesive includes special fluorescent pigments that glow upon exposure to low-power UV light. The adhesive subsystem 114 is coupled to and under the control of the print controller 116 as will be described in more detail with reference to the methods shown and described below. In general, the print controller 116 is able to control the adhesive applicator 138 such that drops of adhesive may be applied at predetermined locations on the page and with varying thickness as desired.

The feed assembly 104 includes a paper tray/feeder 126, a plurality of rollers 122, and a feed motor 124. The paper tray/feeder 126 holds blank paper upon which printing is deposited. A plurality of rollers 122 pull the paper from the paper tray/feeder 126 and advance the paper within the range of and over the print head assembly 102. These components may be of a conventional type known to those skilled in the art. The feed motor 124 powers the set of rollers 122 to move the paper in the exact increment needed to ensure a continuous image is printed. In one embodiment, the feed motor 124 is a stepper motor. The feed motor 124 is coupled for communication with the control circuitry 108 to control the movement of the paper. For example, when conventional printing is performed by the printer 100, the paper speed through the printer 100 may be at its fastest. However, when performing tactile printing the speed at which sheets are processed may need to be reduced to allow the adhesive to be applied and cured. Those skilled in the art will recognize that there are a plurality of speeds at which the feed motor 124 and the control circuitry 108 may cause pages (or even areas within a page) to transition past the print head assembly 102. In addition, as mentioned above, the curing UV source 120 may be included in the paper feed assembly 104 (as opposed to the print head assembly 102) and placed at the paper eject path to cure the entire paper at once, or as the paper is egressed from the printer.

Figure 2:
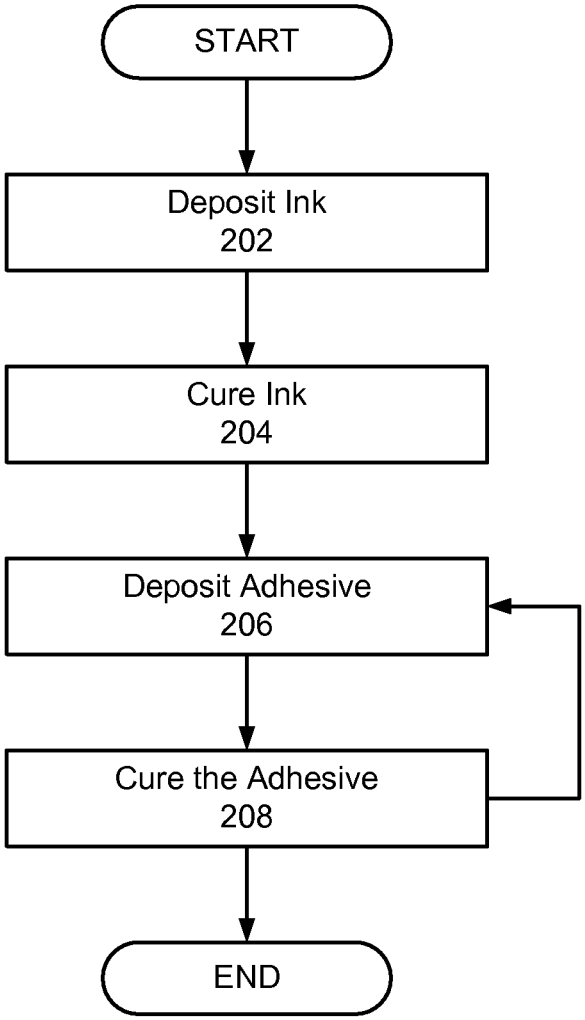
FIG. 2 is a flowchart illustrating a process for tactile printing using an inkjet printer according to one embodiment of the present invention.

FIG. 2 is a flowchart illustrating a process for tactile printing using an inkjet printer, such as printer 100 illustrated in FIG. 1, according to one embodiment of the present invention. The process begins with the printer 100 depositing 202 ink on the paper as it passes the ink print head 132. The ink is then allowed to cure 204. This could be relatively instantaneous depending on the type of ink, or may be just be the drying of the ink. Those skilled in the art will recognize that this step may be omitted for many technologies where the ink does not requiring any special curing. Then the process deposits 206 adhesive on the paper at the desired locations. The process passes the paper past the curing source 120 to cure 208 the adhesive to form tactile features. Those skilled in the art will recognize that that there are number of combinations in which the steps of the above process may be performed. For example, in one embodiment, the ink may be printed over the entire page at the locations desired, the adhesive applied over the entire page at the locations desired and the entire page cured. In an alternate embodiment, a line of ink is deposited as desired, then a line of adhesive is applied as desired, then the line is cured, before the paper is advanced to perform all (or none of the) three steps for the next line such as represented by the line looping from step 208 to 206.

It should be noted that the ink printing and adhesive deposition is separate; with adhesive being deposited after ink printing is finished. This is to avoid mingling the adhesive with the ink. In another embodiment, the incoming paper already has ink printed on it and the method starts with depositing 206 UV adhesive. In other words, the printer 100 of the present invention may be used in three modes: a first where convention ink printing is performed; a second where conventional ink printing is performed and tactile printing is performed; and a third where only tactile printing is performed on a paper that already has information. For example, the third mode may be used to add Braille on top of a normally printed document.

The method of tactile printing described in FIG. 2 is not limited to an inkjet printer 100. A similar process for tactile printing can also be used in laser printer according to one embodiment of the present invention. The laser printer first deposits toner and fuses the toner in place. Then the printer deposits UV adhesive and cures adhesive with a UV LED. Those skilled in the art will recognize that there embodiments when the curing and fusing are accomplished in a single step. Those skilled in the art will further recognize that the process of the present invention may be extended to other printing technologies.

Those skilled in the arts will recognize that the present invention can be used for a variety of different embossing applications. For example, the present invention may be used with internet mapping data to output relief maps that use the tactile printing of the present invention to provide the raised feel of elevated areas. Similarly, the present invention may be used for CAD, blue prints and real estate flyers to provide a tactile feel for floor plans. One well suited application of this method is for the printing of Braille. The printing could not only be on paper, but labels for areas near buttons and any number of different types of plastic ID cards (Braille library cards, for example). Furthermore, the present invention can be used for resumes, business cards and any other items to provide raised and/or color highlighting, callouts, raised icons or logos. Still further, the transparent tactile adhesive can be used for document authenticity and for encoded information. For example, the adhesive may be used to add a hard to duplicate pattern such as a seal, emblem or logo that can be used to detect authenticity. Similarly, the adhesive may be used to add invisible bar codes (lines of normally transparent adhesive may be deposited in a barcode pattern, visible only to low-power UV light). These are just a few of the many applications for the method of the present invention.

Figure 3:
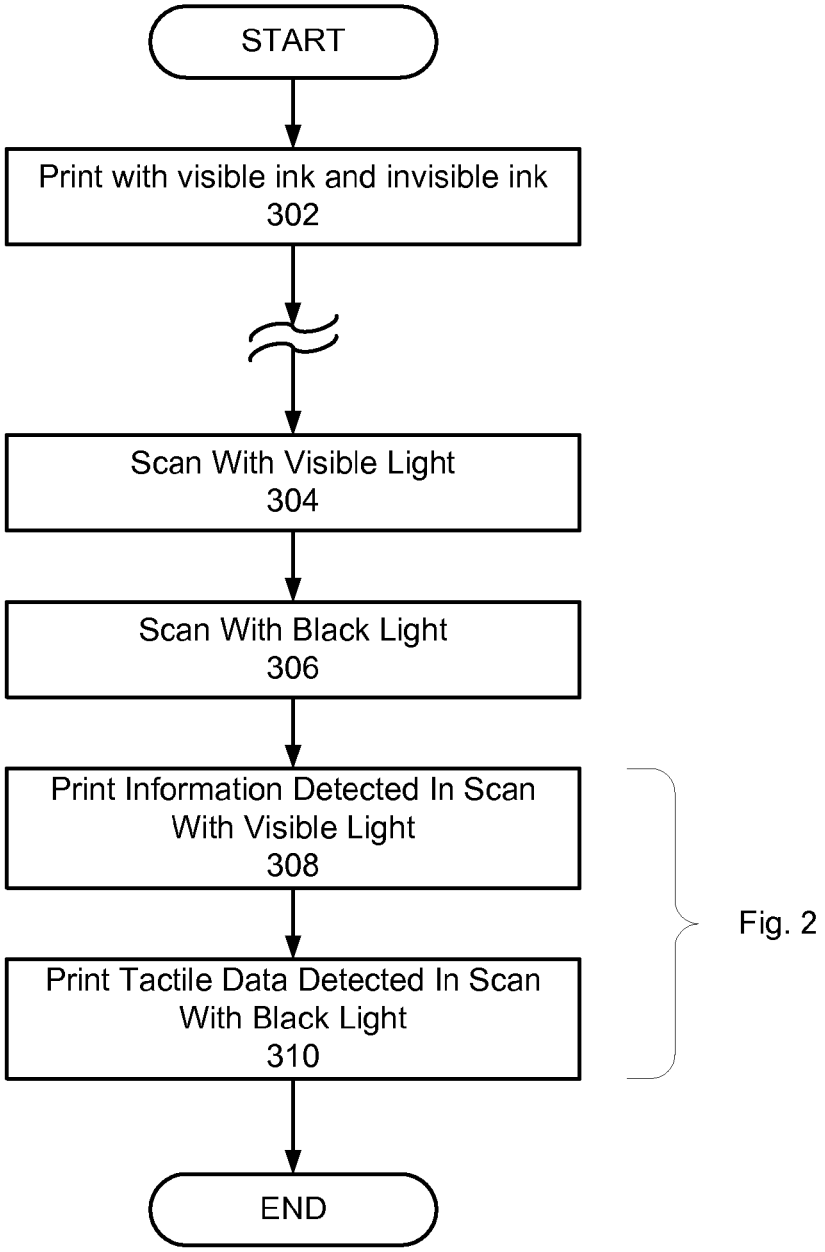
FIG. 3 is a flowchart illustrating a process for copying a tactile document with tactile printing according to one embodiment of the present invention.

FIG. 3 is a flowchart illustrating a process for copying a tactile document with tactile printing according to one embodiment of the present invention. This enables, among other things, Braille document duplication in a single device. As was noted above, the adhesive may include special components not visible to the unaided human eye. Specifically, in one embodiment, the adhesive includes special fluorescent pigments that glow upon exposure to low-power UV light. Documents printed with the tactile printing method as described herein may also be duplicated by using a scanner with both visible light and black light scanning capabilities. Visible light scanning is the conventional scan of ink printing and copying. The term "black light" as used herein refers to low-power UV light that causes the special fluorescent pigments in UV adhesive to glow, thus a black light scan can capture the information printed with UV adhesive. In such an embodiment, the method is performed by the printer 100 of FIG. 1 enhanced to include a "black light" scanner. This is particularly advantageous because it allows duplication of tactile printed documents where the duplication includes both copying of the ink printed information and the adhesive printed information. One embodiment for such a process is shown in FIG. 3.

The process begins with a document being printed 302 using a tactile printing method as has been described above with reference to FIG. 2. This first step may occur spaced out in time from the remaining steps of the method—for example even weeks, months or years before the remaining steps of the method are performed.

Next, two scans are performed on a tactile document, one scan with visible light for ink 304 and one scan with black light 306 for cured tactile adhesive. The information from each scan is temporarily stored. Then, the information captured in the visible light scan is printed 308 with ink, and the information captured in the black light scan is printed 310 with UV adhesive, followed by the curing of the adhesive. In one embodiment, the tactile duplicating is implemented as a one-step process in an MFP (MultiFunction Peripheral, or also known as MultiFunction Printer) where a single device acts as a printer, a scanner and a copier. In another embodiment, a 2-stop tactile duplicating is accomplished by a black-light enabled scanner and a tactile-printing enabled printer. Those skilled in the art will recognize that printer 100 provides the user with options to output three different versions of the scanned document: one with visible ink only, one with tactile information only and one with ink and tactile information.

Figure 4:
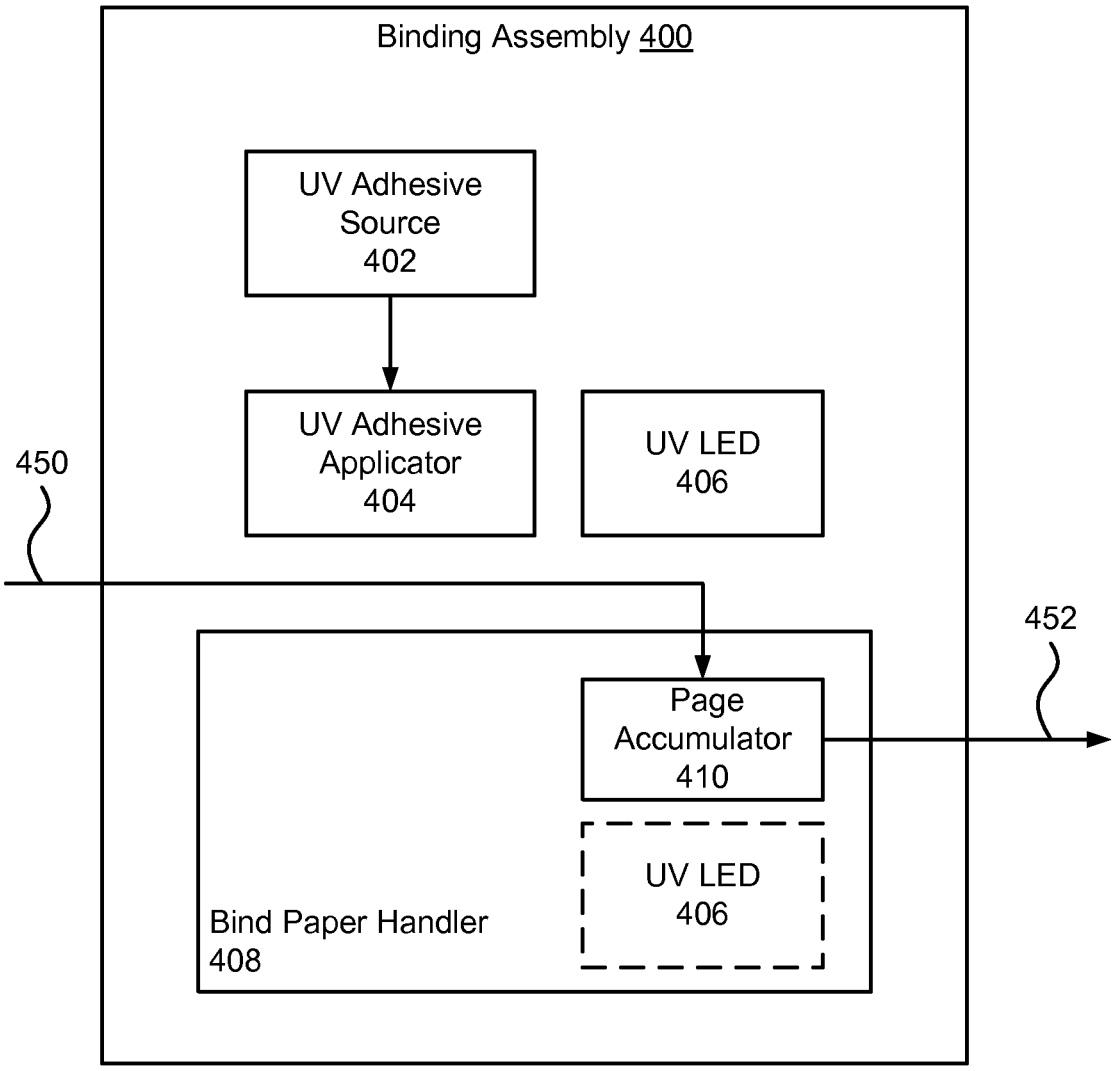
FIG. 4 is a block diagram illustrating a functional view of a bind head assembly used for binding papers according to one embodiment of the present invention.

In addition to printing tactile information such as Braille, the printing of tactile information has variety of other applications. For example, the UV adhesive used in the present invention may be used for binding separate sheets of media or papers. For these enhanced applications, the printer must also include a binding assembly 400. FIG. 4 is a block diagram illustrating a functional view of a binding assembly 400 used for binding papers according to one embodiment of the present invention.

In one embodiment, the binding assembly 400 is part of a separate binder unit in an MFP such as a duplex tray that is used to store and bind pages of documents. The binding assembly 400 includes a UV adhesive applicator 404 such as a UV adhesive bind head coupled to a UV adhesive source 402 such as a UV adhesive cartridge for depositing UV adhesive on paper. The curing UV LED 406 may be on the UV adhesive applicator 404 of the bind head assembly 400 as shown in FIG. 4 according to one embodiment. In this configuration, the adhesive is cured in-situ as drops of adhesive are deposited onto a paper. In another embodiment shown with dashed lines, the curing UV LED 406 is not included in the bind head assembly 400, rather it resides in the paper ejection path so that it cures all adhesive deposited on the paper at one time. The bind head assembly 400 also includes a bind paper handler 408 including a stepper motor for moving the bind head across the paper, and a page accumulator 410 for flattening and pressing the pages together for a good tight bind. A paper path through the binding assembly 400 is shown by lines 450, 452. Those skilled in the art will realize that for proper page binding, the adhesive actually needs to absorb into the paper, so it may be a different viscosity (200-400 cP). Also note that bindings do not have to be on the edge as traditionally considered, but could be down the middle of a page for a half-fold pamphlet.

Figure 5:
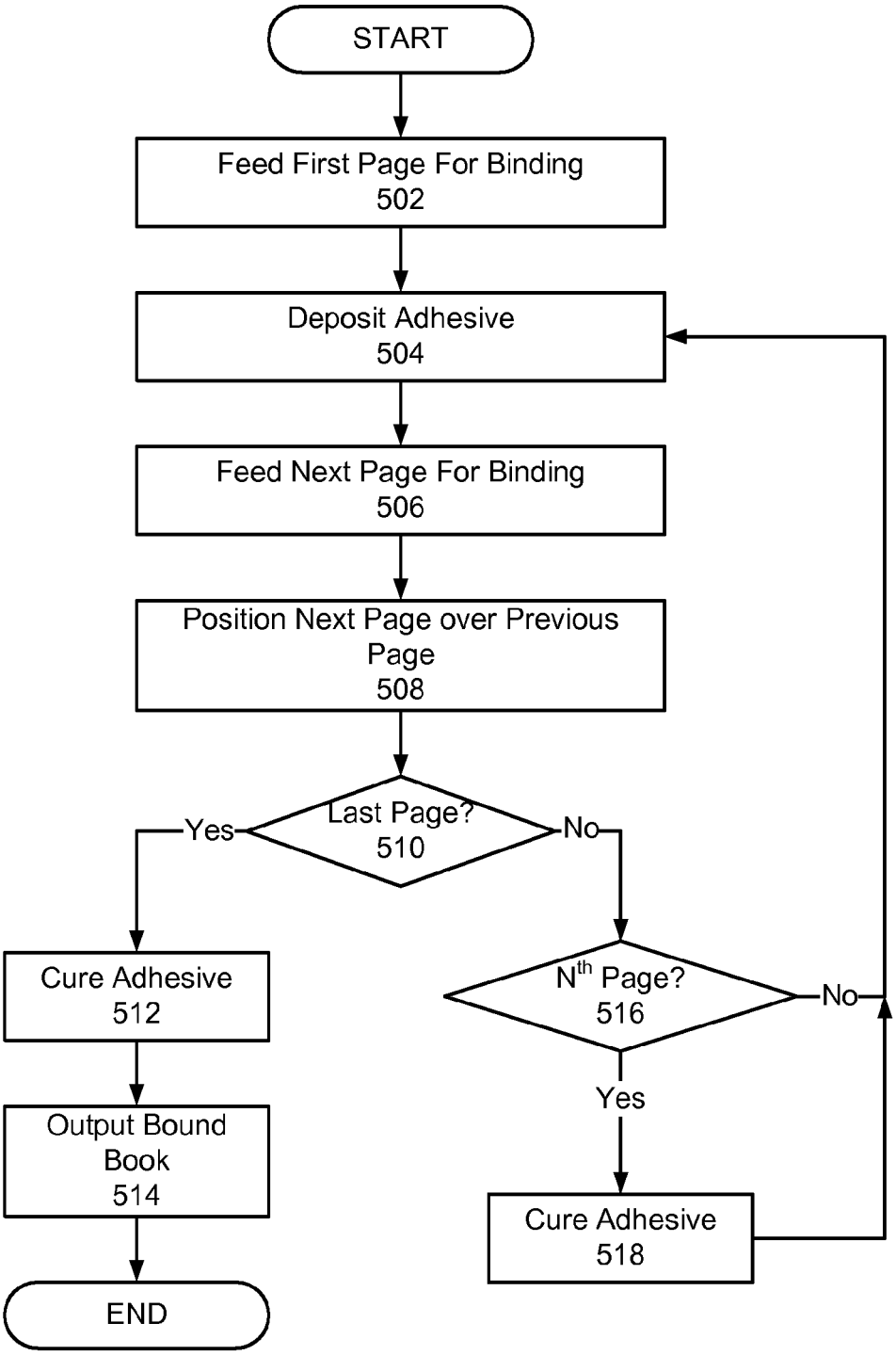
FIG. 5 is a flowchart illustrating a process for media binding according to one embodiment of the present invention.

FIG. 5 is a flowchart illustrating a process for media binding according to one embodiment of the present invention. The process starts by feeding 502 a first page to the bind paper handler 408 of the binding assembly 400 illustrated in FIG. 4. Then the UV adhesive applicator 404 deposits 504 UV adhesive on the first page at a location where the page needs to be bound together by forming, for example, multiple separate droplets, or a strip formed of droplets that have merged together, or even a linear drag of the applicator. For example, droplets may be proximate any peripheral edge of the stack of sheets of paper, or in the center of the paper to create a half-fold pamphlet. Alternatively, droplets may be a few in a corner to bind the sheets of paper similar to a staple. Next, the binding assembly 400 feeds 506 a next page that needs binding to the bind paper handler 408. Next, the bind paper handler 408 positions 508 the next page over the previous page. For example, papers may be positioned in the page accumulator 410. In one embodiment, the page accumulator 410 also presses the next page against the previous page to make a tight bind in addition to stacking the pages on top of each other. Next, the method determines 510 whether the next page that has just been fed, applied with adhesive, stacked and pressed is the last page to be bound. If it is the last page, the method continues in step 512 to cure the adhesive to make a permanent bind. In one embodiment, the adhesive is cured by activating the UV LED 406 to apply UV light to the adhesive. After the adhesive has cured, the sheets of paper are output 514 as a bound book or document. If the last-fed page is determined not to be the last page to be bound in step 510, the process then determines 516 whether it is the $N^{th}$ page, where N is a positive integer that defines the number of pages to be cured in one pass of UV exposure. For example, adhesive binding up to 3 pages may be cured in one pass according to one embodiment of the present invention. If the last-fed page is the $N^{th}$ page, the process cures 518 the adhesive first before it returns to step 504 to deposits adhesive on the page. If the last-fed page is not the $N^{th}$ page, the process returns to step 504 to deposit adhesive on the page without UV curing. In either case, after the adhesive is deposited onto the last-fed page, the process continues in step 508 to feed the next page.

While the present invention has been described in the context of permanently binding sheets of paper such as for a bound document or a book, the binding process can be used for other applications. For example, by modifying the type of adhesive, the method of FIG. 5 may be used to create a pad of "sticky notes" or "repositionable notes." In such an embodiment, a different non-permanent adhesive is used. In yet another embodiment, the adhesive is only partially cured as will be understood to those skilled in the art. In contrast to the permanent curing realized in book binding, the adhesive in sticky notes is partially cured in steps 512 and 518, and gives a tacky-sticky feel, so that the note pages can be easily removed and re-attached. In still another embodiment, the process illustrated in FIG. 5 is used to make sticky notes with specially identified adhesive that is safe in liquid form. In yet another embodiment, sticky notes are made with envelope glue-type adhesive that is permanently cured on individual note page, and may become re-attachable when it is moistened.

Figure 6:
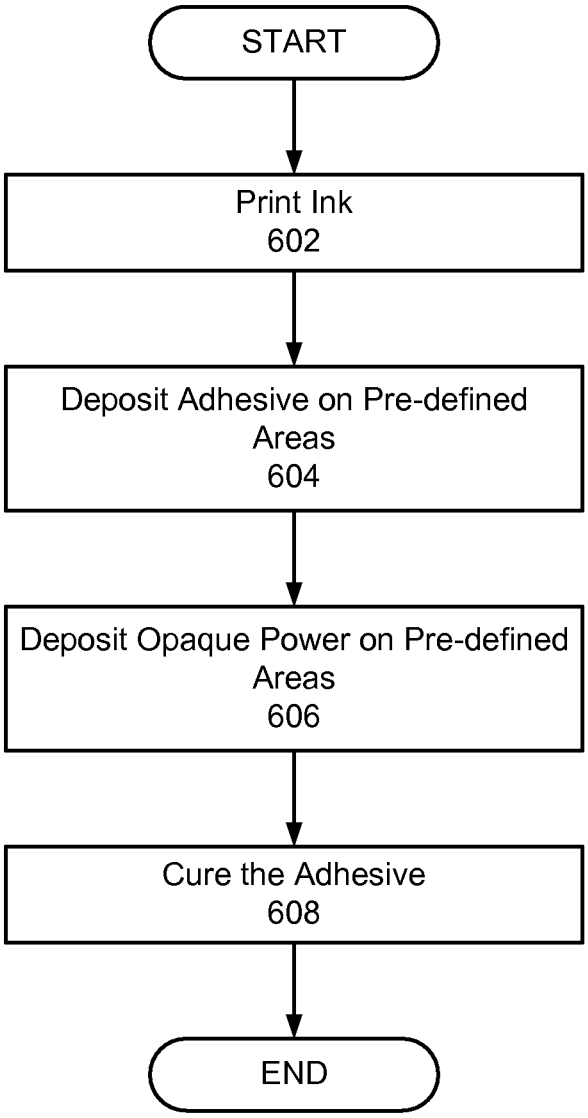
FIG. 6 is a flowchart illustrating a process for printing a scratch-off according to one embodiment of the present invention.

FIG. 6 is a flowchart illustrating a process for printing a scratch-off according to one embodiment of the present invention. Scratch offs are used for a variety of marketing purposes and for lottery tickets. The process begins by printing 602 conventional ink on the media as has been described above. Next the method applies 604 adhesive to selected areas over the conventional ink also as has been described above. In this embodiment, the adhesive has a viscosity such that it will adhere to the paper and also be capable of receiving an opaque powder. The method deposits 606 opaque powder over the surface of the paper. In an alternate embodiment, the process may partially cure the adhesive between the step of depositing 604 the adhesive and depositing 606 the opaque powder. In areas where there is adhesive, the power adheres to the adhesive to form the scratch off portion that keeps the information underneath the adhesive and powder concealed. The excess powder is removed and the media is passed on and the adhesive is cured 608. In another embodiment, the opaque powder may be scented thereby allowing the printing of scratch-and-sniff documents.

Figure 7:
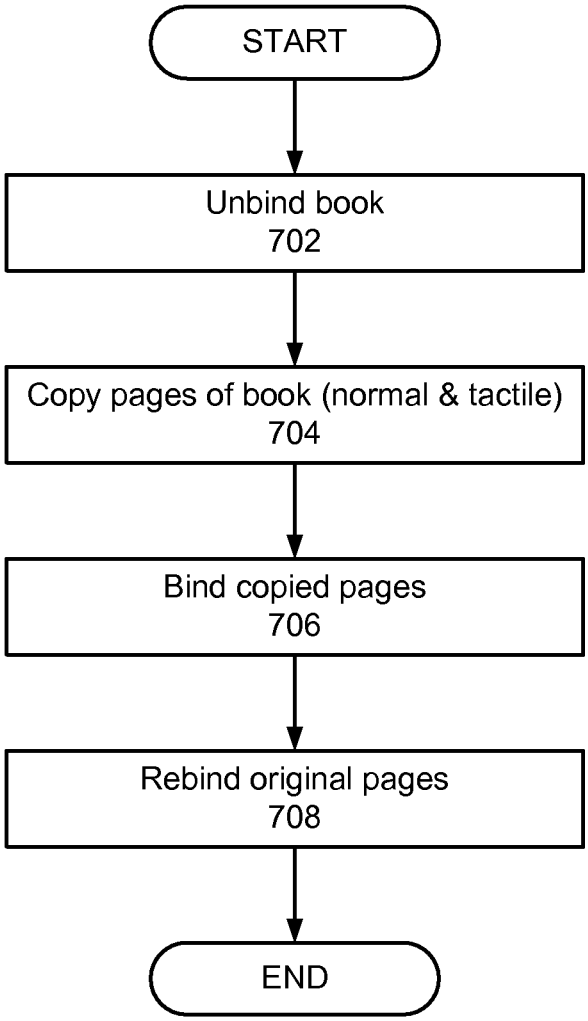
FIG. 7 is a flowchart illustrating a process for copying a bound document according to one embodiment of the present invention.

FIG. 7 is a flowchart illustrating a process for copying a bound document according to one embodiment of the present invention. The process begins by unbinding 702 the input document. The bound document may be mechanically unbound to separate the sheets of paper from each other. For example, the pages may be peeled or ripped apart from each other, a cutter could cut the binding off, a cutter could cut the pages to separate them from each other or any of various other techniques for separating pages known to those skilled in the art may be employed. Once the pages have been separated, the method copies 704, both tactile and normal printing, as has been described above with reference to FIG. 3. The copies are then bound together as was described above with reference to FIG. 5. Once step 706 is complete, the copy of the book is complete and output. A final step of reassembling the original pages that were copied and binding 708 is performed to return the book or document to its original form.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats. Furthermore, as will be apparent to one of ordinary skill in the relevant art, the modules, routines, features, attributes, methodologies and other aspects of the present invention can be implemented as software, hardware, firmware or any combination of the three. Also, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

What is claimed is:

1. A method for tactile printing on a first output medium, the method comprising:

moving, with a motor in a printer, the first output medium at a first speed;

depositing, with an ink print head in the printer, a visible ink on the first output medium;

providing a clear liquid adhesive in an uncured form, the clear liquid adhesive including clear fluorescent pigments;

adjusting the first speed of the motor to a second speed, the second speed being lower than the first speed and being sufficient for moving the first output medium to complete deposition and cure the clear liquid adhesive on the first output medium;

depositing the clear liquid adhesive as droplets of about 0.25-0.75mm high on top of at least a portion of the visible ink to a predefined area on the first output medium, the clear liquid adhesive capable of retaining a tactile shape;

curing, with a curing source in the printer, the clear liquid adhesive to form tactile regions on the first output medium;

scanning, with a black light scanner, the first output medium to detect fluorescent pigments in the clear liquid adhesive;

identifying input information from the fluorescent pigments for creating tactile regions; and depositing the clear liquid adhesive on a second output medium to create a copy of the input information on the second output medium.

2. The method of claim 1, wherein curing the clear liquid adhesive includes exposing the clear liquid adhesive to a light.

3. The method of claim 2, wherein the light is in an ultraviolet (UV) spectrum.

4. The method of claim 1, wherein the clear liquid adhesive has a sufficiently high viscosity to substantially retain the tactile shape on the first output medium before a completion of curing the clear liquid adhesive that is on the first output medium.

5. The method of claim 4, wherein the sufficiently high viscosity has a maximum value of 5000 CentiPoises.

6. The method of claim 1, wherein the visible ink is used to form a map and the clear liquid adhesive provides a raised feel of elevated areas on the map.

7. The method of claim 1, wherein depositing the visible ink, depositing the clear liquid adhesive and curing the clear liquid adhesive are performed during less than 10 passes of the first output medium by a print assembly.

8. The method of claim 1, wherein the clear liquid adhesive is a high viscosity ultraviolet (UV) curable adhesive and wherein curing the clear liquid adhesive includes radiating a UV light on the clear liquid adhesive.

9. The method of claim 1, wherein the curing occurs in about one second.

10. The method of claim 1, further comprising:

scanning the first output medium for input information in the visible ink; and printing the input information on the second output medium.

11. The method of claim 1, wherein the first output medium is one from the group of paper, cardboard, plastic, metal and wood.

12. The method of claim 1, further comprising:

partially curing the clear liquid adhesive;

depositing an opaque powder to the clear liquid adhesive to conceal a portion of the visible ink on the first output medium, the portion of the visible ink underneath the clear liquid adhesive and the opaque powder; and wherein curing the clear liquid adhesive binds the opaque powder and the clear liquid adhesive together.

13. The method of claim 1, wherein the tactile regions on the first output medium form Braille.

14. The method of claim 1, further comprising using the first output medium to create at least one of a label, an identification card, a resume or a business card.

15. The method of claim 1, wherein the printer is a multifunction printer.

16. The method of claim 1, wherein the printer is an inkjet printer.

17. The method of claim 1, wherein the visible ink and the clear liquid adhesive visible ink are used to form a floor plan and the clear liquid adhesive provides a raised feel of elevated areas on the floor plan.

* * * * *